United States Patent [19]

Banzhaf

[11] 4,327,683

[45] May 4, 1982

[54] APPARATUS AND METHOD FOR CONTROLLING THE COMPOSITION OF THE OPERATIONAL MIXTURE IN INTERNAL COMBUSTION ENGINES

[75] Inventor: Werner Banzhaf, Sindelfingen, Fed. Rep. of Germany

[73] Assignee: Robert Bosch GmbH, Stuttgart, Fed. Rep. of Germany

[21] Appl. No.: 85,075

[22] Filed: Oct. 15, 1979

[30] Foreign Application Priority Data

Nov. 3, 1978 [DE] Fed. Rep. of Germany ..... 2847709

[51] Int. Cl.[3] ..... F02D 9/02

[52] U.S. Cl. ..... 123/327; 123/452

[58] Field of Search ..... 123/327, 328, 452, 454, 123/505

[56] References Cited

U.S. PATENT DOCUMENTS

| | | | |
|---|---|---|---|
| 2,395,748 | 2/1946 | Mallory | 123/327 |
| 3,491,732 | 1/1970 | Dahm et al. | 123/328 |
| 3,996,904 | 12/1976 | Kobuki et al. | 123/328 |
| 3,999,524 | 12/1976 | Kobayashi et al. | 123/328 |
| 4,084,558 | 4/1978 | Hattori et al. | 123/327 |
| 4,178,890 | 12/1979 | Yamabe et al. | 123/327 |
| 4,205,645 | 6/1980 | Eheim | 123/454 |

*Primary Examiner*—Ira S. Lazarus
*Assistant Examiner*—Magdalen Moy
*Attorney, Agent, or Firm*—Edwin E. Greigg

[57] ABSTRACT

An apparatus for controlling the composition of the operational mixture in internal combustion engines. Air quantity is controlled to correspond to an arbitrarily settable fuel quantity, by creating a set-point fuel quantity signal from an actual value air quantity signal, via a performance graph, the fuel signal taking the form of a correspondingly set metering cross section in a fuel supply line. A differential pressure valve, connected across the metering cross section, creates a hydraulic control pressure for actuating an air throttle valve in accordance with the deviation of the pressure drop across the metering cross section from a set-point value which is kept constant. During overrunning, the pressure drop becomes zero and the throttle valve is fully opened by hydraulic control pressure supplied through a pressure-actuated valve which opens when the pressure downstream of the metering cross section rises to a value indicating an overrunning condition.

4 Claims, 1 Drawing Figure

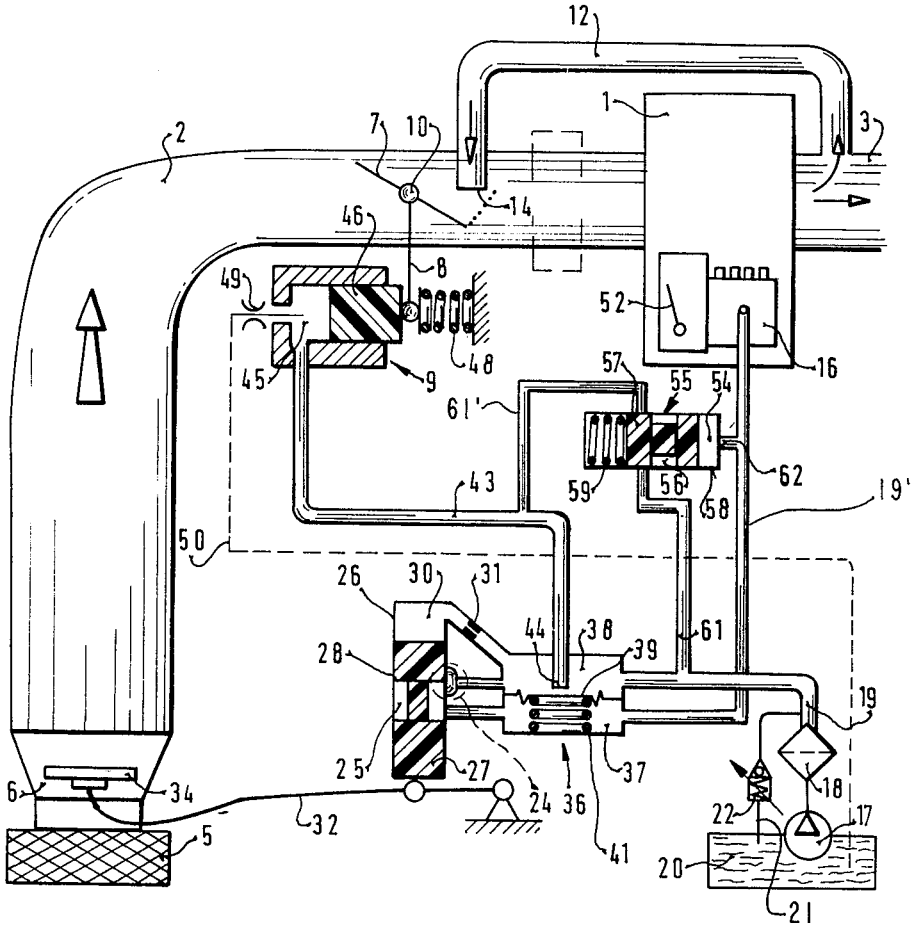
12
1
3
2
7
10
14
46
8
49
52
48
45
9
16
57
55
54
61'
62
59
56
58
19'
43
50
26
30
31
44
38
39
61
28
19
25
27
37
6
34
24
36
18
22
17
32
5
41
20
21

APPARATUS AND METHOD FOR CONTROLLING THE COMPOSITION OF THE OPERATIONAL MIXTURE IN INTERNAL COMBUSTION ENGINES

BACKGROUND OF THE INVENTION

The invention relates to an apparatus for controlling the composition of the operational mixture to be introduced into the combustion chambers of an internal combustion engine.

In known apparatus for controlling the composition of a fuel mixture, the quantity of fresh air is controlled to correspond to an arbitrarily settable fuel quantity, by a throttle valve disposed in the fresh air intake line. In such an apparatus, the fuel metering quantity is reduced to zero during engine overrunning in accordance with the control principle there realized, and the fresh air intake cross section is accordingly also closed by the throttle valve. If the engine is now brought into loaded operation by adjustment of the fuel metering quantity, then during the dead time of the controlled system, the fresh air is insufficient. This produces a disadvantageous increase in soot in the exhaust gas of the engine.

OBJECT AND SUMMARY OF THE INVENTION

Therefore, it is a primary object of the invention to improve the above-described prior known apparatus for controlling the composition of a fuel mixture for an internal combustion engine, to prevent smoke formation, upon resumption of loaded operation, following a period of overrunning operation.

The apparatus in accordance with the invention has the advantage over the prior art in that a means of recognizing overrunning is realized in a simple manner, and during overrunning the throttle valve is fully opened by increasing the working pressure in the hydraulic servomotor to the level of system pressure. Then, during the transition to loaded operation, the fresh air quantity necessary for the combustion of the introduced fuel is available.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE shows schematically one exemplary embodiment of the invention, which will be described in detail below.

DESCRIPTION OF THE PREFERRED EMBODIMENT

In the drawing, an internal combustion engine 1 is shown in simplified form with an intake manifold 2 and an exhaust manifold 3. The inlet of the intake manifold 2 is provided with an air filter 5. Adjacent the air filter 5, the intake manifold 2 includes an especially profiled air funnel 6 which widens in the direction of flow toward the internal combustion engine. Downstream from the air funnel 6 in the intake manifold 2, a throttle valve 7 is provided. A shaft 10 of the throttle valve 7 is connected by a rod 8 with a hydraulic servomotor 9. Downstream of the shaft 10 of the throttle valve 7, an exhaust recirculation line 12 leading from the exhaust manifold 3 is arranged to discharge into the intake manifold 2. The exit opening 14 of this exhaust recirculation line 12 is located in the pivoting range of the half of the throttle valve 7 located downstream of the shaft 10 and is closed thereby when the throttle valve 7 is fully opened. The internal combustion engine 1 in this instance is embodied as an auto-ignition engine and is supplied with fuel in a known manner by an injection pump 16. This may be either an in-line injection pump or a distributor-type injection pump, which functions in accordance with the overflow principle or the throttle valve principle.

The injection pump 16 is supplied with fuel by a fuel supply pump 17 via a fuel filter 18 and a fuel inlet supply line 19 and a fuel outlet supply line 19'. A pressure control valve 22 is connected in parallel arrangement with the fuel filter 18 and fuel supply pump 17, between the fuel inlet supply line 19 and a pressure outlet line 21 leading to the fuel supply container 20. With this pressure control valve 22, a predetermined and substantially constant fuel supply pressure can be attained, which can further be influenced over a long period in accordance with selected operational parameters, such as air pressure or temperature.

A variable metering cross section 24 is connected with the fuel inlet supply line 19 and is embodied as a slit-like flow-through cross section of the fuel inlet supply line 19 which discharges into an annular chamber 25 in a guide bore 26. This annular chamber 25 is defined by a circumferential annular groove of a control slide 27 which is displaceable within the guide bore 26. One limitation edge 28 of the control slide 27 controls the free cross section, in accordance with the position of the control slide 27, of the slit-like metering cross section 24 which extends in the direction of displacement of the control slide 27 in the wall of the guide bore 26. The annular chamber 25 is connected to the suction side of the injection pump 16 by a fuel outlet supply line 19' which is not closed by the control slide 27. The metering cross section 24 may of course also be provided in the opposite location, at the exit point of the fuel inlet supply line 19 out of the annular chamber 25.

The control slide 27, on one end, encloses a pressure chamber 30 in the guide bore 26, which pressure chamber 30 communicates via a throttle 31 with the fuel supply line 19 upstream of the metering cross section 24. As a result of the fuel pressure prevailing in this pressure chamber 30, the control slide 27 is pressed against a pivot arm 32, which is supported at one end and on whose other, free end which projects into the region of the air funnel 6, is secured a baffle plate 34 which extends across the air flow direction. Against the substantially constant force generated by the fuel pressure and transmitted by the control slide 27, this baffle plate 34 is deflected by the backed-up pressure of the air flow or the pressure differential which acts upon it between the air pressure upstream and the air pressure downstream of the baffle plate 34, this deflection lasting until such time as a balance of forces has been established. With the aid of the special profile of the air funnel 6 it can be attained that for the continuous increase in the free annular surface area between the baffle plate 34 and the air funnel wall for the purpose of maintaining a constant pressure difference at the baffle plate 34, differing adjustment paths of the baffle plate 34 are required. On the other hand, by means of the slit-like embodiment of the metering cross section 24 it is attained that the metering cross section varies in linear fashion with the adjustment path of the baffle plate 34. When the restoring force on the control slide 27 is kept constant, a desired ratio of air to fuel can thus be set which is adapted to the various operational ranges of the engine.

The pressure drop at the metering cross section 24 is controlled by a differential pressure valve 36. Therein a first pressure chamber 37 communicates with the fuel inlet supply line 19 downstream of the metering cross section 24 and a second pressure chamber 38 communicates with the fuel outlet supply line 19' upstream of the metering cross section 24. In the illustrated example, these pressure chambers are located directly in the fuel inlet supply line 19 and the fuel outlet supply line 19'. The two pressure chambers are separated by a diaphragm 39, which is loaded on the side of the first pressure chamber 37 by a compression spring 41. A relief line 43, includes a mouth or opening 44 and together with the diaphragm 39 these elements comprise a valve. The mouth 44 projects into the second pressure chamber 38 perpendicular to the surface of the diaphragm 39.

The relief line 43, which acts as a servo medium supply line, leads into a work chamber 45 of the servomotor 9. The servomotor 9 includes a servo device 46, embodied here by way of example as a working piston, which is urged against the hydraulic servo force by a compression spring 48. The servo device 46, which may also be embodied, for example, as a diaphragm, is thus coupled with the rod 8 for the purpose of adjusting the throttle valve 7. The work chamber 45 also communicates with the fuel supply container 20 via a fixed throttle 49 in a return flow line 50.

The apparatus described above functions as follows:

When a quantity adjustment device of the injection pump 16 is adjusted via a lever 52 in the direction of a large fuel injection quantity on the basis of steady operational state of the internal combustion engine, then more fuel must be supplied to the injection pump 16 via the outlet fuel supply line 19'. However, with the position of the control slide 27 which is at first constant, this causes a greater pressure drop at the metering cross section 24 and a drop in the pressure in the first pressure chamber 37 of the differential pressure valve 36. This valve 36 acts as a comparison apparatus, with which the actual fuel quantity supplied to the engine can be compared with the induced fresh air quantity, which in turn, given a set, required slope in the fuel-air ratio, corresponds to the quantity of fuel which flows through the metering cross section 24. The pressure drop in the first pressure chamber 37 causes an adjustment of the diaphragm 39 and thus an enlargement in the opened cross section at the outlet opening 44 of the relief line 43. The fuel discharge quantity thereby increased causes an increase in the pressure establishing itself at the throttle 49, which pressure in turn, being exerted in the work chamber 45, causes an adjustment of the servo device 46 against the force of the compression spring 48. The throttle valve 7 is accordingly moved in the opening direction, which in turn, leads to an increase in the quantity of fresh air supplied and a simultaneous reduction in the recirculated exhaust gas quantity.

As a result of the enlarged flow-through cross section of the intake manifold 2 at the throttle valve 7, in intake underpressure generated by the internal combustion engine 1 can now be exerted more strongly at the baffle plate 34, so that the baffle plate 34, under the effect of the briefly increased pressure differential, is deflected still further outward, until a balance of forces is again established at the pivot arm 32 as a result of increasing the free annular surface area (that is, reduction of the throttling effect) at this flow-through cross section. As a result of the adjustment of the pivot arm 32, the metering cross section 24 has also changed, so that the pressure drop at the metering cross section 24, determined by the design of the differential pressure valve 36, is reestablished. The variation of the fuel quantity being discharged through the relief line 43 corresponds to the product of the comparison between the fuel quantity actually supplied and the induced fresh air quantity; that is, to the deviation from the set-point value established at the differential pressure valve 36.

In the opposite case, if the lever 52 is moved in the direction of a small fuel quantity or even a zero fuel quantity, then the control procedure described above is carried out in reverse. As a result of the reduced fuel supply quantity to the fuel injection pump 17, the pressure in the first pressure chamber 37 first rises, so that the diaphragm 39 moves in the closing direction toward the mouth or opening 44 of the relief line 43. In turn, the pressure in the work chamber 45 decreases, and the compression spring 48 moves the throttle valve 7 in the closing direction, until the pressure in the second pressure chamber 38 is equalized as a result of the corrective adjustment of the control slide 27.

During overrunning, with a set injection quantity of zero, the pressure in the first pressure chamber 37 rises to the level of the system pressure, and the throttle valve 7 is accordingly fully closed. When the driver next "gives the gas", that is, when loaded operation is resumed, then at first a lack of air prevails in the combustion chambers of the engine during the dead time of the controlled system, which causes incomplete combustion and a sharp increase in soot components in the exhaust gases. In order to avoid this, a pressure monitoring apparatus is provided, as a result of which, when a reference value characterizing overrunning is exceeded, communication can be established between system pressure and the work chamber 45 of the servo device 9.

The pressure monitoring apparatus in the illustrated example includes a connecting line 61 which leads from the inlet fuel supply line 19 upstream of the metering cross section 24 directly to the relief line 43. A switching valve 55 is disposed in the connecting line 61 and has a closing member which, because of the pressure prevailing in the fuel outlet supply line 19' between the metering cross section 24 and the injection pump 16, is displaced against the force of a spring in such a manner that the connecting line 61 is closed. To this end, a spool-like control piston 57, having an annular groove 56, is provided in a cylinder 58. The connecting line 61 from the inlet fuel supply line 19 discharges into the cylinder 58 through one side thereof and extends from the cylinder 58 through an opposite side line 61' to the relief line 43. The control piston 57 has one end face which encloses a work chamber 54 in the cylinder 58. The chamber 54 has only one connecting line 62 to the portion of the fuel outlet supply line 19' between the metering cross section 24 and the injection pump 16. On an opposite end face, the control piston 57 is subject to the force of a compression spring 59.

If the pressure in the fuel outlet supply line 19' and in the work chamber 54 now increases to such an extent that the reference value which can be set by means of the compression spring 59 is exceeded, then the annular groove 56 moves into the discharge area of the connecting line 61, as a result of which its passage is opened to line 61'. The system pressure now conveyed into the work chamber 45 causes the throttle valve 7 to be fully opened and the exhaust recirculation line 12 is closed. Thus the engine, upon resumption of loaded operation and especially in the case of the sudden movement of the lever 52 to full load, has sufficient air at its disposal for combustion. After the end of the dead time of the controlled system, the pressure in the fuel outlet supply line 19' between the metering cross section 24 and the injection pump 16 drops to the usual operational level, in which the reference value characterizing overrunning is not attained and thus, by means of the displacement of the control valve 57, the connecting line 61 is closed. From this moment on, the control apparatus functions as described previously.

The form chosen for this embodiment may be very easily realized with the drive means already available. Naturally, the opening or closing of the connecting line 61 can take place in a different equivalent manner, such as by means of an electromagentic valve which is actuatable by an electric pressure monitoring apparatus.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In an apparatus for controlling the composition of an operational mixture to be introduced into the combustion chamber of an internal combustion engine, having a fresh air intake line, an exhaust line, an exhaust gas recirculation line extending from the exhaust line into the intake line, a fuel supply means for supplying fuel at a substantially constant pressure, fuel quantity adjusting means, and a fuel supply line extending from the fuel supply means to the fuel adjusting means, said apparatus including a fuel throttle, disposed in the fuel supply line and having an adjustable metering cross-section, fuel throttle activating means for adjusting the metering cross-section proportional to the quantity of fresh air flowing into the intake line, an intake line throttle means for controlling, in a complementary manner, the quantity of fresh air and the quantity of exhaust gas admitted to the intake line, an hydraulic servomotor means, having a work chamber, for operating the intake line throttle means, wherein the quantity of fresh air admitted into the intake line is proportional to the pressure in the work chamber, a differential pressure valve means for controlling the flow of fuel therethrough proportional to the pressure across the fuel throttle means, a fuel overflow line, connected at one end to the fuel relief line through the differential pressure valve means, said overflow line including a fixed throttle and being connected to the work chamber of the servomotor means intermediate the differential pressure valve means and the fixed throttle, the improvement which comprises:

a connecting line, having one end connected to the fuel supply line intermediate the fuel supply means and the fuel throttle means, and an opposite end connected to the work chamber of the servomotor;

a normally closed valve, disposed in the connecting line; and valve actuating means for opening the normally closed valve whenever the pressure in the fuel supply line downstream of the fuel throttle means exceeds a predetermined reference value.

2. Apparatus for controlling the composition of an operational fuel mixture for an internal combustion engine, as described in claim 1, wherein said normally closed valve and said valve actuating means comprise:

a cylinder, having a first end and an opposite, second end, the first end being connected to the fuel supply line intermediate the fuel throttle means and the fuel quantity adjusting means downstream of said fuel throttle means, one side of the cylinder being connected to the fuel supply line intermediate the fuel supply means and the fuel throttle means by one portion of the connecting line, and an opposite side of the cylinder being connected to the work chamber of the servomotor by another portion of the connecting line;

a control piston, slidably disposed within the cylinder for movement between open and closed positions, the side of the control piston defining an annular groove which connects the two portions of the connecting line when the control piston is disposed in its open position; and a spring, disposed in the second end of the cylinder, which exerts a force on one end of the control piston in a closing direction, against another force exerted on an opposite end of the control piston in an opening direction by the pressure prevailing in the fuel supply line intermediate the fuel throttle means and the fuel quantity adjusting means.

3. In an apparatus for controlling the composition of an operational mixture to be introduced into the combustion chamber of an internal combustion engine, having a fresh air intake line, an exhaust line, an exhaust gas recirculation line extending from the exhaust line into the intake line, a fuel supply means for supplying fuel from a fuel supply chamber at a substantially constant pressure, fuel quantity adjusting means, and inlet and outlet fuel supply lines extending from the fuel supply means to the fuel adjusting means, said apparatus including a fuel throttle, disposed between the inlet and outlet fuel supply lines and having an adjustable metering cross-section, fuel throttle activating means for adjusting the metering cross-section proportional to the quantity of fresh air flowing into the air intake line, an air intake line throttle means for controlling, in a complementary manner, the quantity of fresh air and the quantity of exhaust gas admitted to the intake line, a hydraulic servomotor means, having a work chamber, for operating the air intake line throttle means, wherein the quantity of fresh air admitted into the air intake line is proportional to the pressure in the work chamber, a differential pressure valve means for controlling the flow of fuel therethrough from said fuel inlet supply line to said fuel outlet supply line proportional to the pressure across the fuel throttle means, a pressure relief line connected between said differential pressure valve means and said work chamber, a fuel return line, said fuel return line including a fixed throttle and being connected to the work chamber of the servomotor means and to the fuel supply chamber, the improvement which comprises:

a connecting line including first and second portions, said first portion having one end connected to the fuel inlet supply line intermediate the fuel supply means and the fuel throttle means, said second portion having one end connected to said relief line;

a normally closed valve, disposed in the connecting line and connected between said first and second positions; and valve actuating means for opening the normally closed valve whenever the pressure in the fuel outlet supply line downstream of the fuel throttle means exceeds a predetermined reference value.

4. Apparatus for controlling the composition of an operational fuel mixture for an internal combustion engine, as described in claim 3, wherein said normally closed valve and said valve actuating means comprise:

a cylinder, having a first end and an opposite, second end, the first end being connected to the outlet fuel supply line intermediate the fuel throttle means and the fuel quantity adjusting means downstream of said fuel throttle means, one side of the cylinder being connected to the inlet fuel supply line intermediate the fuel supply means and the fuel throttle means by said first portion of the connecting line, and an opposite side of the cylinder being connected to the work chamber of the servomotor by said second portion of the connecting line;

a control piston, slidably disposed within the cylinder for movement between open and closed positions, said control piston including an annular groove which connects said first and second portions of the connecting line when the control piston is disposed in its open position; and a spring, disposed in the second end of the cylinder, which exerts a force on one end of the control piston in a closing direction, against another force exerted on an opposite end of the control piston in an opening direction by the pressure prevailing in the outlet fuel supply line intermediate the fuel throttle means and the fuel quantity adjusting means.

* * * * *